US005596824A

United States Patent [19]

Scott et al.

[11] Patent Number: 5,596,824

[45] Date of Patent: *Jan. 28, 1997

[54] SINGLE SHOVEL EARTH MOVING AND COMPACTING RIG

[76] Inventors: Thomas M. Scott; David R. Scott, both of Rte. 1-Box 914, Petersburg, W. Va. 26847

[ * ] Notice: The term of this patent shall not extend beyond the expiration date of Pat. No. 5,398,430.

[21] Appl. No.: 402,848

[22] Filed: Mar. 13, 1995

Related U.S. Application Data

[63] Continuation of Ser. No. 838,167, Feb. 20, 1992, Pat. No. 5,398,430, and a continuation of Ser. No. 702,405, May 20, 1991, abandoned, and a continuation of Ser. No. 369,607, Jun. 21, 1989, abandoned.

[51] Int. Cl.[6] ..... C02F 3/28

[52] U.S. Cl. ..... 37/403; 37/904; 414/723

[58] Field of Search ..... 37/904, 447, 403, 37/444, 445, 341, 443; 404/133.2; 366/108; 209/420, 421, 394, 676 X; 414/722, 723, 686; 173/184, 185, 28; 56/8, 400.11; 172/40

[56] References Cited

U.S. PATENT DOCUMENTS

| | | | |
|---|---|---|---|
| 683,775 | 10/1901 | Kirkpatrick | 37/444 |
| 1,466,200 | 8/1923 | Stair | 294/68.23 |
| 2,142,794 | 1/1939 | Matthews . | |
| 3,003,265 | 10/1961 | Lutjens . | |
| 3,072,257 | 1/1963 | Houkenberry . | |
| 3,334,744 | 8/1967 | James et al. | 209/394 |
| 3,732,980 | 5/1973 | Evers et al. | 209/421 |
| 3,917,426 | 11/1975 | Wohlwand et al. | 404/133.2 |
| 4,043,694 | 8/1977 | Mullen | 404/133.2 |
| 4,157,956 | 6/1979 | Robinson | 209/262 |
| 4,189,386 | 2/1980 | Aman | 210/235 |
| 4,592,696 | 6/1986 | Carternock | 37/904 |
| 4,679,337 | 7/1987 | Carternock et al. | 37/904 |
| 4,698,150 | 10/1987 | Wigoda | 209/421 |
| 4,698,926 | 10/1987 | Caplis et al. | 37/403 |
| 4,790,717 | 12/1988 | Anderson | 414/722 |
| 5,140,760 | 8/1992 | Mannbro | 37/444 |
| 5,172,498 | 12/1992 | Wack | 37/904 |
| 5,195,865 | 3/1993 | Koehl | 37/904 |
| 5,398,430 | 3/1995 | Scott et al. | 37/184 |
| 5,489,029 | 2/1996 | Jonckleere et al. | 209/676 |

FOREIGN PATENT DOCUMENTS

| | | | |
|---|---|---|---|
| 1016187 | 4/1963 | United Kingdom | 37/461 |
| 1336988 | 9/1969 | United Kingdom | 37/184 |

*Primary Examiner*—Terry Lee Melius
*Assistant Examiner*—Robert Pezzuto
*Attorney, Agent, or Firm*—Walter G. Finch; Nancy A. Smith

[57] ABSTRACT

An earth moving and tamping apparatus rig is provided which can backfill a trench and compact the backfill materials up to 100% compaction. A bucket and a vibrator are attached to a backhoe. The bucket retrieves the filling material and either dumps the material into a trench or sifts it through adjustable screening blades that form the bottom of the bucket. The apparatus includes a means to swivel the bucket with respect to the vibrator. The end of the bucket then compacts the filling materials into the trench. Each moving rig apparatus may also be equipped with an alternative two-bucket system, where one bucket fits inside the other one or is along side thereof. For trenches as wide as two feet to increase the area of dirt tamped, the two-bucket may be secured in juxtaposition to each other. For more narrow trenches, the second bucket may be secured inside the first bucket and the area tamped will only be the width of a single bucket. The earth moving and tamping apparatus rig is a device by which a backfilling job may be done more efficiently and less expensive than the present method employing multiple workers and machines.

22 Claims, 5 Drawing Sheets

SINGLE SHOVEL EARTH MOVING AND COMPACTING RIG

BACKGROUND AND SUMMARY OF THE INVENTION

This patent application is a continuation of U.S. patent application Ser. No. 07/369,607 filed Jun. 21, 1989 by Applicants for "Earth Moving and Compacting Rig" and a continuation of U.S. patent application Ser. No. 07/702,405 filed May 20, 1991, and U.S. patent application Ser. No. 07/838,167 now U.S. Pat. No. 5,398,430, both for "Earth Moving and Compacting Rig" by applicants.

This invention relates generally to construction and earth moving machinery, and more specifically it pertains to an apparatus for backfilling trenches and compacting the filling material.

The main essence of this device is that it enables one man to operate one machine to perform a task that ordinarily would require several men and machines. Where a backfilling job normally needs a loader or bulldozer to fill the trench, and a hand operated wicker or backhoe plates to compact it, this earth moving rig of this invention can do the entire job alone.

The rig accomplishes this by using a bucket to load dirt and release it into a ditch. The bucket then swivels so that the flat end of it may be used to tamp down the dirt, while an attached vibrator unit aids in compaction of the dirt. Operated by a single worker, one earth moving rig obtains results that heretofore necessitated multiple machines and workers.

The uniqueness of the rig is that it includes a means by which to retrieve dirt and place it in a recess as well as a means by which to vibrate the bucket and compact the dirt filling material. While dirt retrieval and compaction are ordinarily functions of separate pieces of equipment, this invention is a combination of both.

Versatility of function is possible by a means for swiveling the bucket with respect to the vibrator. An operator can swivel the bucket hydraulically or manually to fit the position desired for tamping, and bolt the apparatus so that the vibrator and bucket rotate with respect to each other. In this manner, the end of the bucket may be used with the vibrator to tamp down the filling material.

This invention also includes a means by which the dirt may be screened for unwanted large rocks or debris. The bottom of the bucket is made up of adjustable blades that may be clamped in a variety of fixed positions, i.e., up, down or partially down. A removable handle manipulates the clamp.

When the blades are clamped up, the opening between them allows the dirt to sift through while the larger rocks and debris are caught. Blades clamped down close the openings and permit no material to filter through. Thus, the earth moving rig can screen the filling material or not, as the operator chooses.

The rig may also be equipped with an adjustable two-bucket system, where one bucket fits inside the other. The advantages of this is the ability to handle backfill material of two bucket quantity, and yet still close one bucket inside the other to provide a narrow dimension tamping plate for narrow ditches. The buckets can be partially closed to provide a wider tamping plate for wider ditches. A second bucket will allow more of the ditch to be tamped.

The two-bucket system functions in the following manner. The buckets retrieve dirt by an opening and grasping motion, similar in fashion to clam's movement. Hydraulic cylinders activate the opening and closing of the buckets. To dump the filling material in the trench, the operator may open the buckets, which allows the material to fall through the separation. The buckets then may be closed until the total surface area of both bucket ends equals the width of the trench.

The buckets can be adjusted simply by opening or closing the buckets to the desired width. The operator may then use the bucket ends and the vibrator to compact the dirt. Consequently, the operator does not need to move the bucket from one side of a two-foot trench to the other, as a single bucket-system would require. In this manner, the two-bucket system speeds up the compaction process.

In summary, the earth moving rig is a single machine that entails one or two buckets, a vibrator, and a means for swiveling the bucket. This invention is capable of backfilling trenches that would normally necessitate a dozer or loader, and compacting the backfill materials in the trench up to 100% compaction. Thus, the invention eliminates the need for clumsy, hand-operated wackers, vibrating backhoe plates, as well as other extra pieces of machinery. While generally useable for most backfill jobs, this apparatus is specifically instrumental during installation of water and sewer lines. Used correctly, the earth moving rig will increase efficiency and cut costs of a backfill job.

OBJECTS OF THE INVENTION

It is an object of this invention to provide an apparatus operational by a single wacker for use in construction and earth moving situations that will backfill a trench or ditch as well as compact the filling materials.

Another object of this invention is to provide a bucket, vibrator, and a means to swivel the bucket with respect to the vibrator.

Still another object of the invention is to provide for a 360° swiveling motion of the bucket connection to the vibrator and boom means of the machine which operates either hydraulically or manually.

And to provide for a means by which to accomplish the first mentioned object as well as use adjustable screening blades to screen unwanted large rocks and debris or not, as the operator chooses is a further object of the invention.

To provide for a means by which to accomplish the first mentioned object along with an alternative two-bucket system that speeds up the compaction process is another object of this invention.

Furthermore, another object of the invention is an alternative two-bucket system that retrieves dirt by a grasping motion wherein the two-bucket system has the capability of handling double the quantity of material as the single bucket system.

To provide for a two-bucket system that opens to dump the filling materials into a trench and closes either with one bucket inside the other or the edges of the buckets just touching is still a further object of this invention.

To provide for a two-bucket system that may tamp material in a ditch up to two feet in width is still a further object of this invention.

Still yet a further object of this invention is that it eliminates the need for other machinery or equipment to perform a backfill job.

And to provide for an apparatus that will compact to rates required by the legal authorities and laws is still a further object of this invention.

To provide for an apparatus that will increase efficiency and cut costs of an ordinary backfill job, is a further object of this invention.

BRIEF DESCRIPTION OF THE DRAWINGS

These and other objects and attendant advantages of this invention will become more obvious from the following drawings and detailed description of the invention wherein.

DESCRIPTION OF THE PREFERRED EMBODIMENTS

Figure 1:
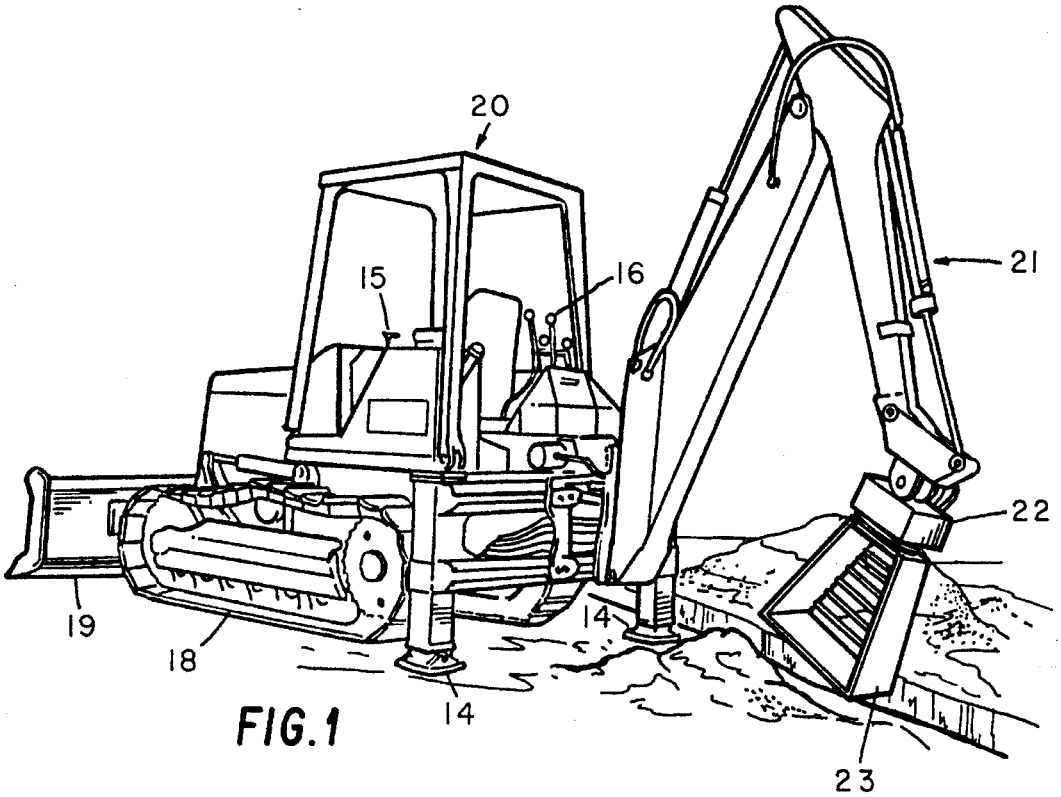
FIG. 1 is a perspective view of an earth moving and tamping rig incorporating features of this invention.

Referring now to FIG. 1 of the drawings, there is shown a backhoe rig 20 complete with a boom 21, on the end of which is attached a vibrator 22 and a bucket 23. In addition, the rig 20 is provided with a blade 19, tracks 18 for moving the rig, and controls 15 for up and down movement of the blade 19 as well as controls 16 for forward and backward motion of the rig 20 for moving and controlling the rig 20. A pair of stabilizers 14 are provided for stabilizing the rig 20.

Figure 2:
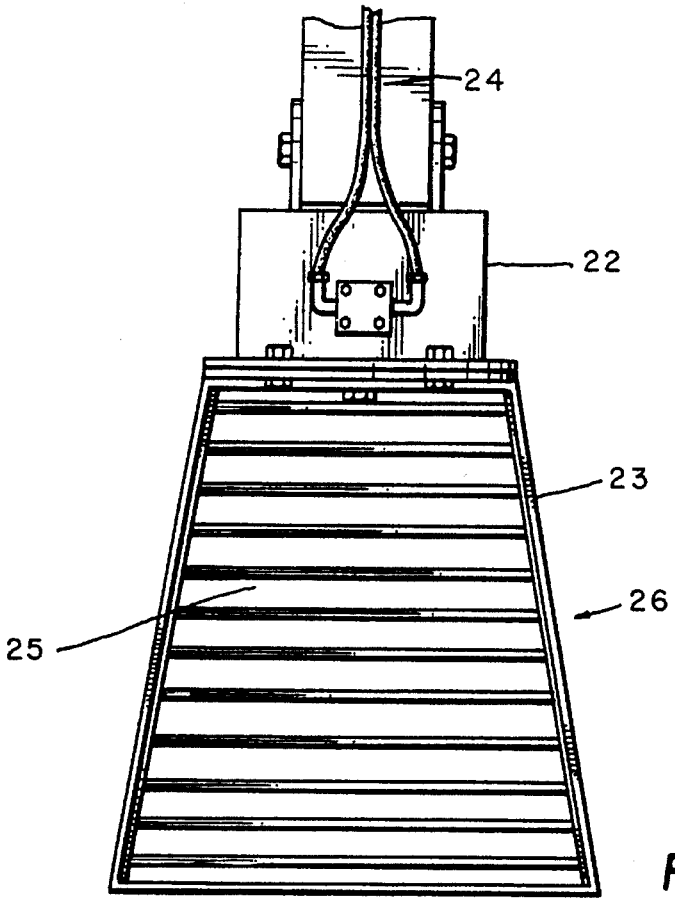
FIG. 2 is a front view of a bucket.

In FIG. 2 there is shown hydraulic lines 24 from the rig to control and activate the vibrator 22, which is attached to one end of the bucket 23. FIG. 2 also shows a plurality of spaced rods 25 for forming a sieve 26 in the bucket 23.

Figure 3:
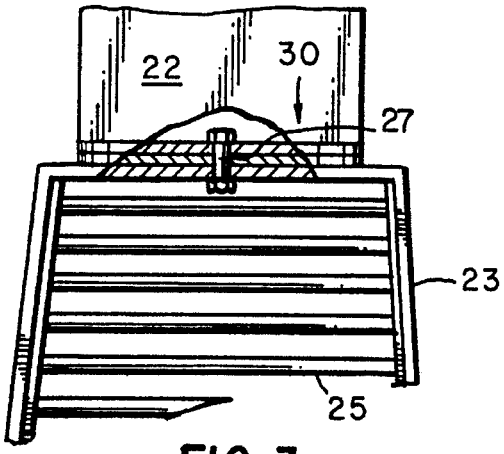
FIG. 3 is a front view of a swivel connection for the bucket.

Referring now to FIG. 3, a swivel 30 is shown consisting of a two headed shaft 27 which joins the vibrator 22 to the bucket 23. Any other suitable connecting arrangement can be used in the swivel 20, such as a bolt.

Figure 4:
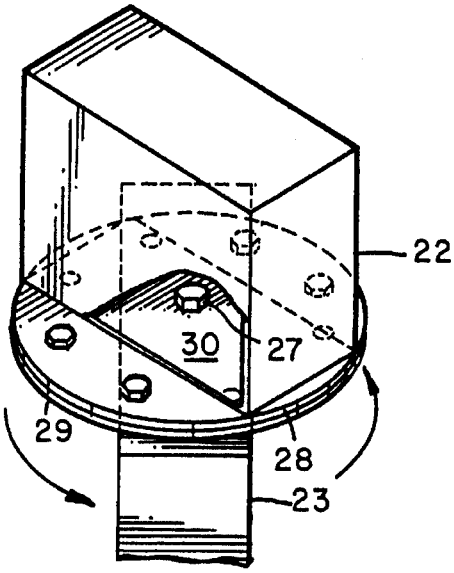
FIG. 4 is a perspective view of a swivel shaft connection for rotating the buckets below the vibrating means.

FIG. 4 shows the swivel mechanism in more detail, where the swivel 30 turns on its shaft 27 and may secure the buckets 23 in place with vibrator 22 in any position needed with locking bolts 33 holding the swivel plates 28 and 29 in a fixed position.

Figure 5:
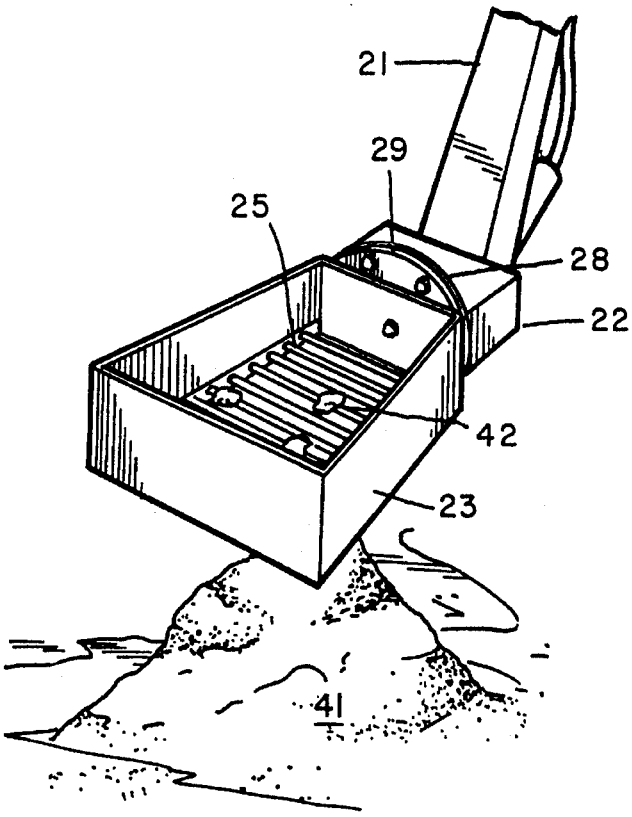
FIG. 5 is a perspective view of the bucket sifting.

Referring now to FIGS. 2, 3 and 5, the screening bars or rods 25 are shown mounted in the hack of the bucket 23 to catch or screen rocks or debris 42 while allowing the dirt 41 to fall through. The vibrator 22 may be activated to aid in shaking the dirt 41 through the screening bars 25.

Figure 6:
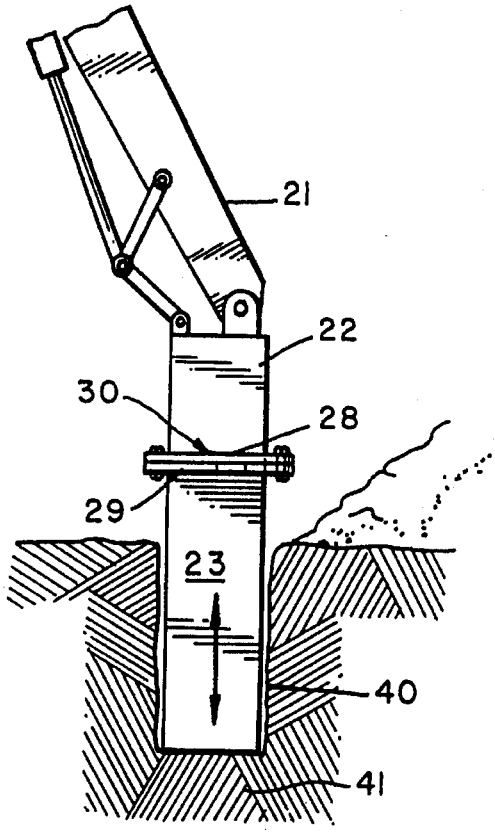
FIG. 6 is a cross section of the bucket pounding down on the earth in a narrow trench.
Figure 7:
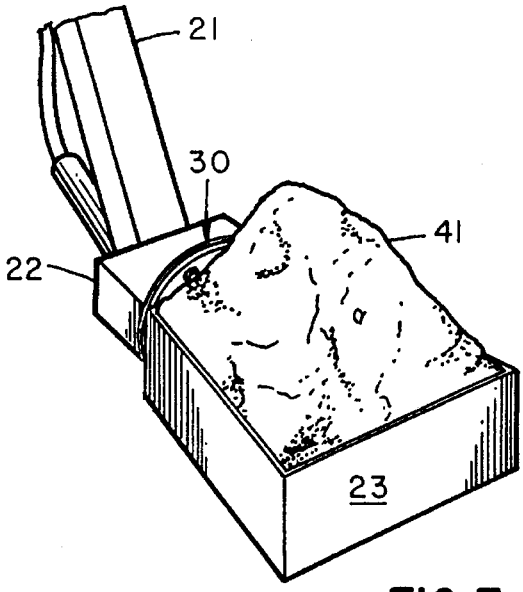
FIG. 7 is a perspective view of the bucket with a full load and base.

Referring now to FIG. 6, the rig 20 is shown tamping or packing the dirt 41 in a trench 40. The vibrator 22 can be activated with the bucket 23 as shown in the position of FIG. 5 to allow the dirt to fall through, with the rocks 42 being retained. In FIG. 7, there is shown a bucket 23 filled with dirt 41. The screening bars 25, best shown in FIG. 5, are closed.

Figure 8:
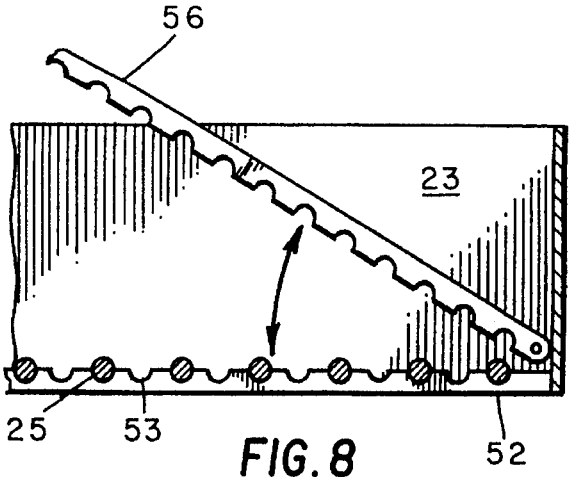
FIG. 8 is a side view of one embodiment of a bucket, partially in cross section, showing the bars used for sifting.

Now referring to FIG. 8, the screening bars 25 of the bucket 23 have an upper clamp 56 and a lower clamp 52 to secure the screening bars 25 in the position desired. There is also shown spaced recesses 53 for receiving the bars 25.

Figure 9:
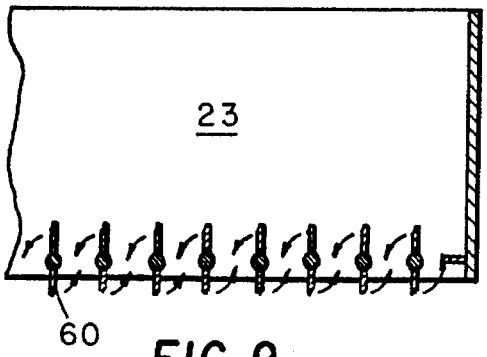
FIG. 9 is a side view of a second embodiment of a bucket, partially in cross section, showing a bucket having a sieve.

FIG. 9 illustrates rotating adjustable blades 60 in the open position in the bucket 23 and may be used as a sieve.

Figure 10:
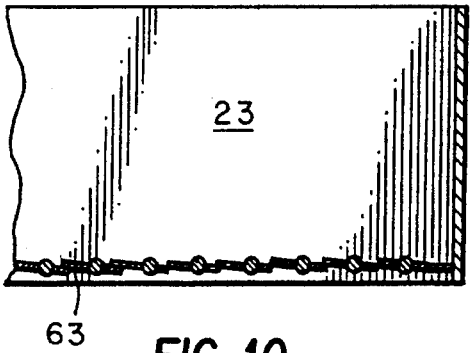
FIG. 10 is a side view, partially in cross section, showing a bucket with a solid base.
Figure 11:
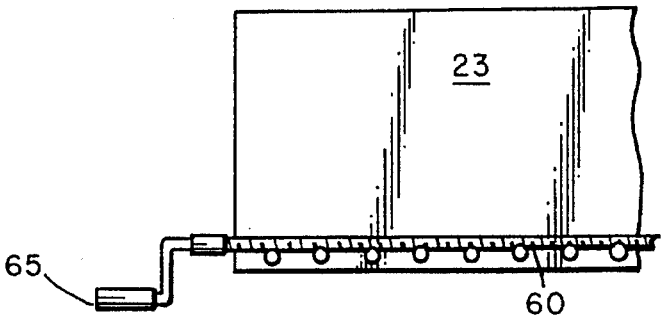
FIG. 11 is a side view, partially in cross section, showing a mechanism for adjusting the base.

Similarly in FIG. 10, the blades 63 are in the closed position in the bucket 23, and a lid base allows no dirt through. A removable handle 65 may be used to adjust the blades 60, manually from the outside of the bucket 23 as shown in the mechanism of FIG. 11.

Figure 12:
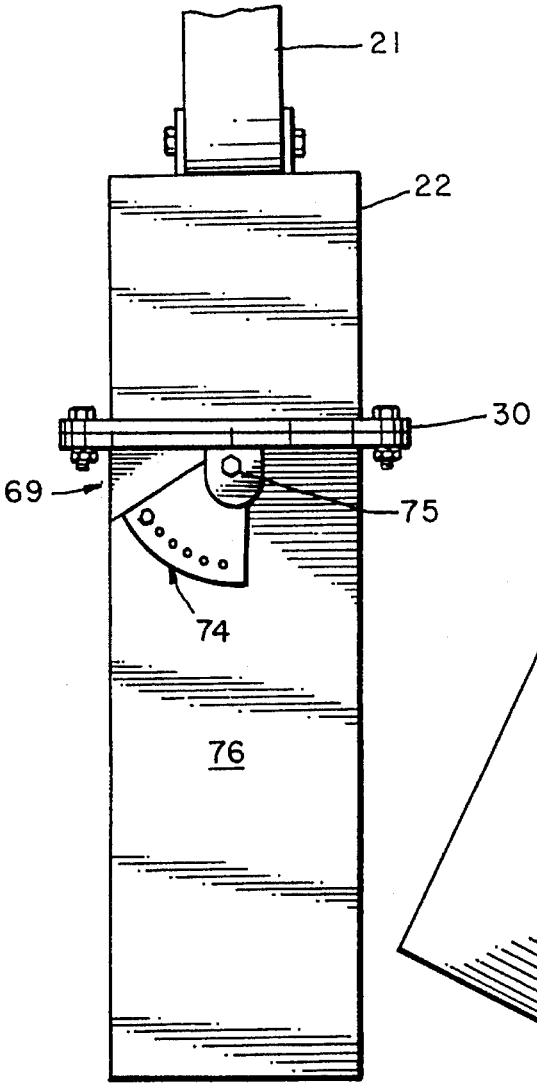
FIG. 12 is a side view of a second embodiment of a bucket showing a clamp mechanism.
Figure 13:
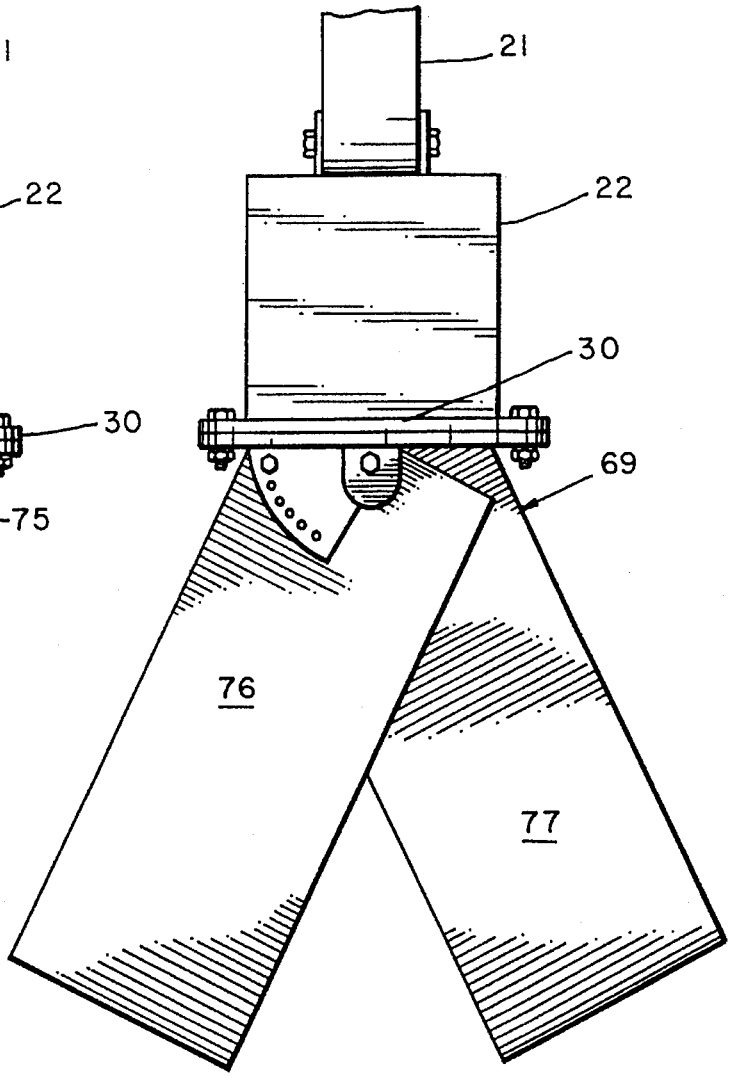
FIG. 13 is a side view of the second embodiment of the bucket in an open position.
Figure 15:
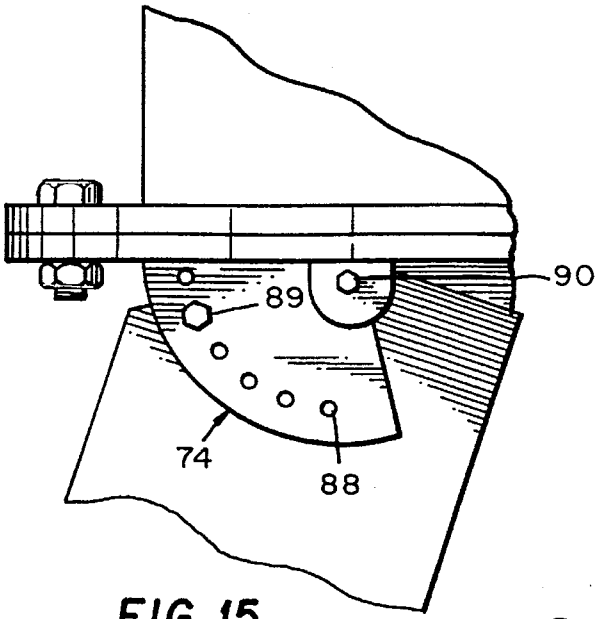
FIG. 15 is a side view showing stop catches for the second embodiment of the bucket.

FIGS. 12 and 13 illustrate a two-bucket system 69 where one bucket 77 is inside the other bucket 76. A stop catch mechanism 74 best shown in FIG. 15, is an adjustment mechanism to stop buckets 76 and 77 from closing all the way together to provide a wider tamping plate at the bottom of buckets 76 and 77 in the bucket system 69. FIG. 13 shows the two buckets 76 and 77 in the open position. The stop catch mechanism 71 is best shown in FIG. 15. A stop catch 89 is caught in an aperture 88, and that stops buckets 76 and 77 from closing all the way together. There are several different apertures 88 for varying the amount that the buckets 76 and 77 are closed. The stop catch mechanism 74 serves as the adjustment means for varying the width of the tamping plate, which is the bottom of the buckets 76 and 77. A hinge joint, 90 best shown in FIG. 15, allows the buckets 76 and 77 to swing open and shut.

Figure 14:
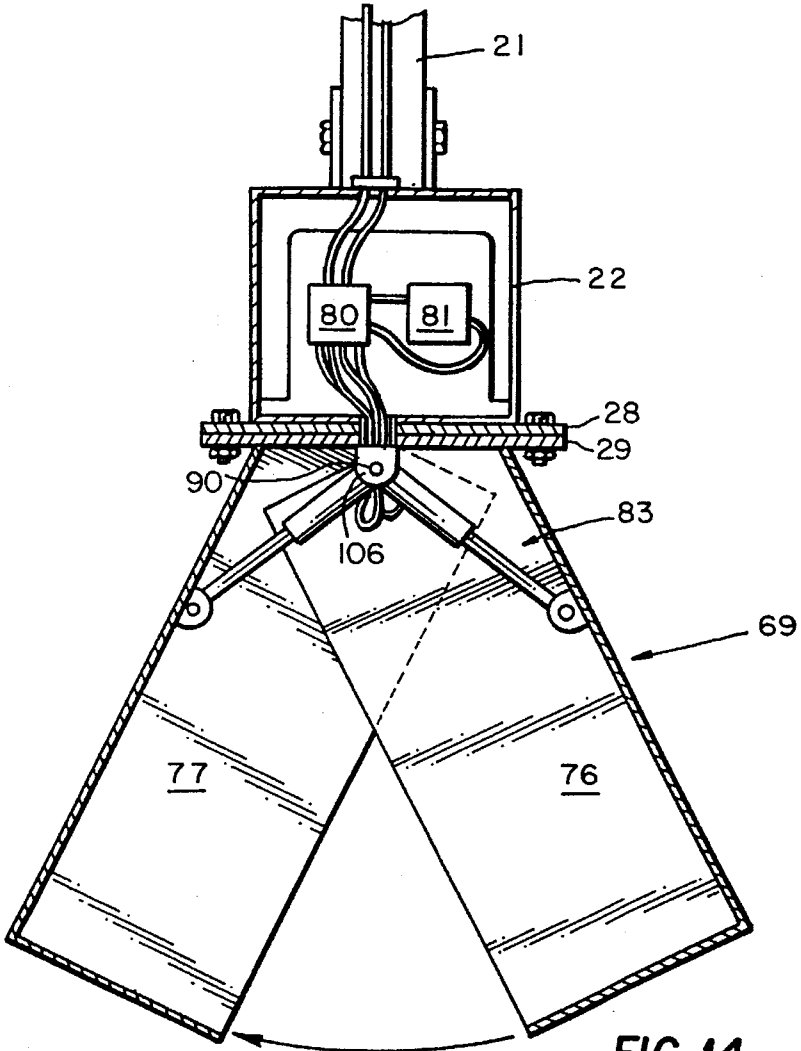
FIG. 14 is a sectional view of the second embodiment of the bucket in an open position as shown in FIG. 13.

The operation of the two-bucket system 69 is best shown in FIG. 14. A hydraulic motor 80 activates the vibrator 22 and a hydraulic control valve 81 activates the buckets 76 and 77 and vibrator 22. Hydraulic cylinders 83 cause the buckets 76 and 77 to swing open or close on the hinge joint 90 best shown in FIG. 15. The pivot shaft 86 allows the combination of both vibrator 22 and buckets 76 and 77 to pivot on the end of the boom 21.

Figure 16:
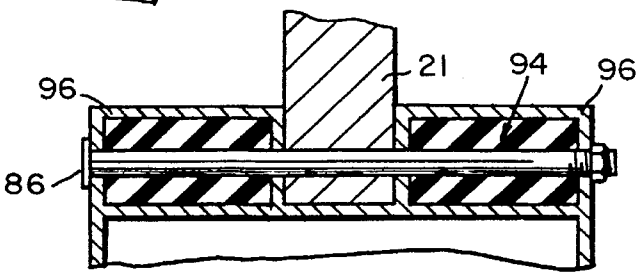
FIG. 16 is a side view partially in cross section of rubber mounts on the back hoe boom to cut down on vibration.

In another version of the invention as best shown in FIGS. 1, 14 and 16, the boom means or supporting arm 21 is connected to the vibrator 22 by a pin attachment shaft 86 located through rubber bushings 94 that are fixed to the top of the vibrator support cage with bushing brackets 96. This connection absorbs vibration from the boom 21 of the vibrator 22 that is bolted to a bottom plate 28 of the vibrator support cage. This, in turn, is bolted to the top plate 29 of buckets 76 and 77 that hinge on shaft 90 with brackets 106. A pin 90 and bracket 106 make up the hinge joint of buckets 76 and 77 that open and close with hydraulic cylinders. Adjustable tamping plates are located at the bottom of the buckets 76 and 77.

Obviously, many modifications and variations of the present invention are possible in light of the above descriptions. It is therefore to be understood that within the scope of the appended claims the invention may be practiced otherwise than as specifically described.

What is claimed is:

1. A system for tamping of material in a trench opening, comprising:

a powered vehicle;

a boom means coupled to said powered vehicle at one end and adjustably controlled therefrom and having an opposite end;

bucket means coupled to said opposite end of said boom means, for forming and filling a trench opening and wherein said bucket means has a flat bottom portion which functions as a tamping plate that fits into said trench opening;

vibrating means coupled to said opposite end of said boom means positioned between said boom means and said bucket means and external of said bucket means for periodically vibrating said bucket means so as to assist in tamping and compacting material dumped in said trench opening by said bucket means; and means positioned between said vibrating means and said boom means for absorbing and minimizing vibrations during the tamping and compacting of material placed by said bucket means in said trench opening.

2. A system for tamping of material in a trench opening as recited in claim 1, wherein said bucket means consists of at least one bucket having a flat bottom portion which functions as a tamping plate and fits into said trench opening.

3. A system for tamping of material in a trench opening as recited in claim 1, wherein said bucket means consists of at least two buckets both having a flat bottom portion which functions as a tamping plate and fits into said trench opening.

4. A system for tamping of material in a trench opening as recited in claim 1, wherein said bucket means consists of a pair of buckets operating as a clamshell bucket, with one of said pair of buckets closing inside the other of said pair of buckets.

5. A system for tamping of material in a trench opening as recited in claim 1, wherein said bucket means has a bottom having a rectangular configuration so that said bottom of said bucket means is flat for use as said tamping plate.

6. A system for tamping of material in a trench as recited in claim 1, further comprising means for swivelling said bucket means to allow said tamping plate to fit into said trench opening at any angular position relative to said trench opening.

7. A system for tamping of material in a trench opening as recited in claim 6, further comprising means for swivelling said bucket means 360 degrees with respect to said boom means and for positioning said bucket means parallel to said trench opening.

8. A system for tamping of material in a trench opening as recited in claim 3, wherein said bucket means includes means for retrieving or grasping material for backfilling said trench opening and for concurrently closing one bucket inside of another bucket.

9. A system for tamping of material in a trench opening as recited in claim 1, wherein said means positioned between said vibrating means and said boom means for absorbing and minimizing vibrations is a cushioning means.

10. A system for tamping of material in a trench opening as recited in claim 1, wherein said bucket means is a single bucket having a sieve means formed in one side thereof.

11. A system for tamping of material in a trench opening as recited in claim 10, wherein said sieve means is plurality of spaced rods positioned in recesses formed in opposite sides of said bucket.

12. A system for tamping of material in a trench opening as recited in claim 10, wherein said sieve means is a plurality of rotatable adjustable blades which when positioned in an open arrangement allow material to pass therebetween or when positioned in a closed arrangement prevent material from passing out of said bucket.

13. A system for tamping of material in a trench opening as recited in claim 10, further comprising means for swiveling said single bucket to any angular position relative to said trench opening.

14. A system for tamping of material in a trench opening as recited in claim 10, wherein said means positioned between said vibrating means and said boom means for absorbing and minimizing vibrations is a cushioning means.

15. A system for tamping of material in a trench opening, comprising:

a powered vehicle;

a boom means coupled to said powered vehicle at one end and adjustably controlled therefrom and having an opposite end;

operable bucket means coupled to said opposite end of said boom means for filling a trench opening and having a flat bottom portion for tamping material in said trench opening;

vibrating means coupled to said opposite end of said boom means positioned between said boom means and said operable bucket means and external to said operable bucket means for periodically vibrating said operable bucket means so as to assist in tamping and compacting said material dumped in said narrow trench opening by said bucket means; and vibrations absorbing and minimizing means positioned between said vibrating means and said boom means for absorbing and minimizing vibrations during said tamping and compacting of said material.

16. A system for tamping of material in a trench opening as recited in claim 15, wherein said bucket means comprises a pair of buckets operating as a clamshell type bucket that has one of said buckets closing inside of another of said buckets thereby providing a narrow dimensioned tamping plate to fit into said trench opening.

17. A system for tamping of material in a trench opening as recited in claim 16, wherein said bucket means includes means for retrieving or grasping earth material of a quantity to fill said bucket means for backfilling a trench, and for concurrently closing one bucket inside another to provide a one bucket compact size tamping plate for deep narrow trenches.

18. A system for tamping of material in a trench opening as recited in claim 15, wherein said vibration absorbing and minimizing means is a cushion means to absorb and prevent vibrations from said vibrating means from passing through to said boom means and said powered vehicle.

19. A system for tamping of material in a trench opening as recited in claim 15, where in said vibrator means is connected electromechanically at one end to a top side of said bucket means and from there connected at an opposite end to said boom means.

20. A system for tamping of material in a trench opening as recited in claim 15, wherein said flat bottom portion of said bucket means has a rectangular box configuration to use as a tamping plate.

21. A system for tamping of material in an opening as recited in claim 20, further comprising means for swivelling said bucket means and said tamping plate 360 degrees relative to said boom means to allow said tamping plate to fit into said trench opening at any angular position relative to said trench opening.

22. A system for tamping of material in a trench opening as recited in claim 20, further comprising means for opening and closing said bucket means for adjusting the width of said tamping plate for utilization in either narrow or wide trenches wherein opening said bucket means increases the width of said tamping plate for wide trench applications, and closing said bucket means decreases the width of said tamping plate for narrow trench applications.

* * * * *